US005878636A

United States Patent [19]

Baker

[11] Patent Number: 5,878,636

[45] Date of Patent: Mar. 9, 1999

[54] SIXTY-DEGREE RATCHET WRENCH

[75] Inventor: David R. Baker, Fort Worth, Tex.

[73] Assignee: David Baker, Inc., Fort Worth, Tex.

[21] Appl. No.: 902,540

[22] Filed: Jul. 22, 1997

Related U.S. Application Data

[60] Provisional application No. 60/022,883 Jul. 25, 1996.

[51] Int. Cl.[6] ..... B25B 13/02

[52] U.S. Cl. ..... 81/119; 81/186

[58] Field of Search ..... 81/119, 120, 186, 81/121, 1, 170

[56] References Cited

U.S. PATENT DOCUMENTS

| | | | |
|---|---|---|---|
| 574,622 | 1/1897 | Olden | 81/119 |
| 2,652,735 | 9/1953 | Wilder | 81/119 |
| 2,671,368 | 3/1954 | Diebold | 81/119 |
| 3,921,476 | 11/1975 | Evans | 81/119 |
| 4,889,020 | 12/1989 | Baker | 81/119 |
| 5,381,710 | 1/1995 | Baker | 81/119 |
| 5,406,868 | 4/1995 | Foster | 81/119 |
| 5,551,322 | 9/1996 | Mikic et al. . | |
| 5,582,083 | 12/1996 | Baker | 81/119 |

*Primary Examiner*—David A. Scherbel
*Assistant Examiner*—Lee Wilson
*Attorney, Agent, or Firm*—James E. Bradley

[57] ABSTRACT

An open-end ratcheting-type wrench for use in driving a hexagonal nut has a handle and a wrench head that is joined to the handle. The wrench head has upper and lower jaws that are rigidly joined together by a web. The jaws have several faces that allow the wrench to be ratcheted about the nut to different drive positions without removing the wrench from the nut. The faces are configured to prevent corner contact with the nut so that the corners are not rounded off. A lock face is provided on the wrench to prevent the removal of the wrench from the nut during use. The lock face has a concave arcuate surface to allow ratcheting.

19 Claims, 7 Drawing Sheets

SIXTY-DEGREE RATCHET WRENCH

BACKGROUND OF THE INVENTION

This application claims the benefit of U.S. Provisional Application Ser. No. 60/022,883, filed Jul. 25, 1996.

1. Field of the Invention

This invention relates in general to wrenches, and in particular, to an open-end wrench that provides ratcheting action.

2. Description of the Prior Art

In a conventional open-end wrench, a rigid jaw is joined to a shank. The jaws have parallel faces that slide over the sides of the nut. After each stroke, the user must remove the wrench from the nut and reposition it on the nut. Typically the nut is hexagonal, with a point or corner every 60°. Because of the necessary clearances required to fit the wrench over the nut, the wrench actually contacts the nut at the corners. This tends to round the corners of the nut, particularly when high torque is required.

A number of patents have issued disclosing open-end wrenches that will ratchet. That is, the user is able to reposition the wrench on the nut for another stroke without having to completely remove the wrench from the nut. The designs have various deficiencies. Many of them drive only on the corners of the nut, tending to round the corners off. They also usually require that the wrench be pulled away from the nut with each repositioning stroke so that the next position is not self-seeking. A wrench that is self seeking has the characteristics of ratcheting from one driving position to the next while being held in contact with the nut. This self seeking characteristic would be due entirely to the design of the various surfaces, faces, points and angles of the wrench in relation to the nut to be turned, and would not require special positioning of the wrench by the user.

Another problem with prior art wrenches is that there is the potential for the wrench to slide off the nut during torque. This is particularly true when high torque is being applied. When this occurs, the user may scrap or injure their hand, particularly when the wrench is being used in confined areas. Notches formed in the drive faces in non-ratcheting-type wrenches have been used in the past to hold the wrench in place on the nut during torque, but not in a 60° self-seeking ratchet-type wrench.

SUMMARY OF THE INVENTION

An open-end ratcheting-type wrench for use in driving a hexagonal nut has a handle and a wrench head that is joined to the handle. The wrench head has upper and lower jaws that are rigidly joined together. The jaws are immovable and spaced apart relative to the other for receiving the hexagonal nut to be driven. An upper drive face is located on the forward end of the upper jaw. The upper drive face is a convex arcuate surface for contacting a first side of the nut being driven when the wrench is in a drive position. An upper backstop face adjoins the upper drive face. The upper backstop face has a convex arcuate surface for contacting a second side of the nut adjacent to the first side when the nut is in the drive position. The upper backstop face coextends generally along the length of the second side of the nut when in the drive position.

A lower backstop face adjoins the upper backstop face and generally coextends along a third side of the nut adjacent to the second side. The lower backstop face is spaced apart from the third side of the nut when the wrench is in the drive position. A lower jaw face adjoins the lower backstop face. The lower jaw face generally coextends along an opposite side of the nut from the first side when the wrench is in the drive position. The lower jaw face has a forward portion that forms a lower drive face. The lower drive face is a convex arcuate surface for contacting the opposite side of the nut when in the drive position. A lock face is joined to the forward portion of the lower jaw face on the forward end of the lower jaw. The lock face is an arcuate concave surface that resists inadvertent disengagement of the wrench from the nut while torque is being applied.

DETAILED DESCRIPTION OF THE PREFERRED EMBODIMENT

Figure 1:
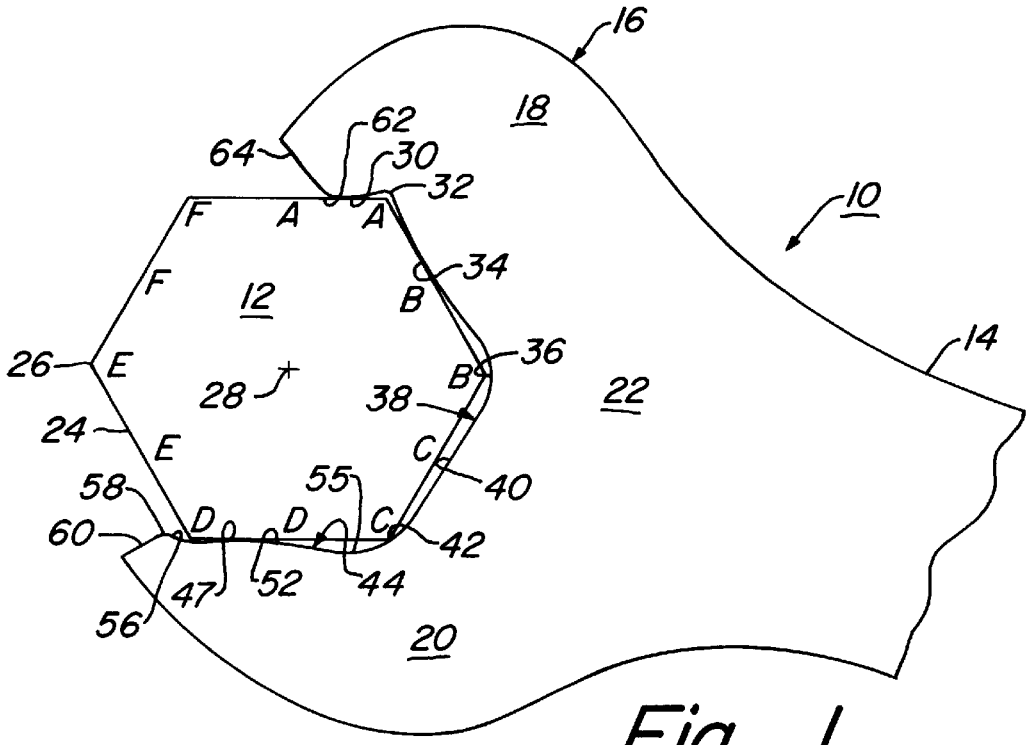
FIG. 1 is a top plan view of a ratchet-type, open-end wrench shown engaged with a nut in the drive position and constructed in accordance with the invention.
Figure 4:
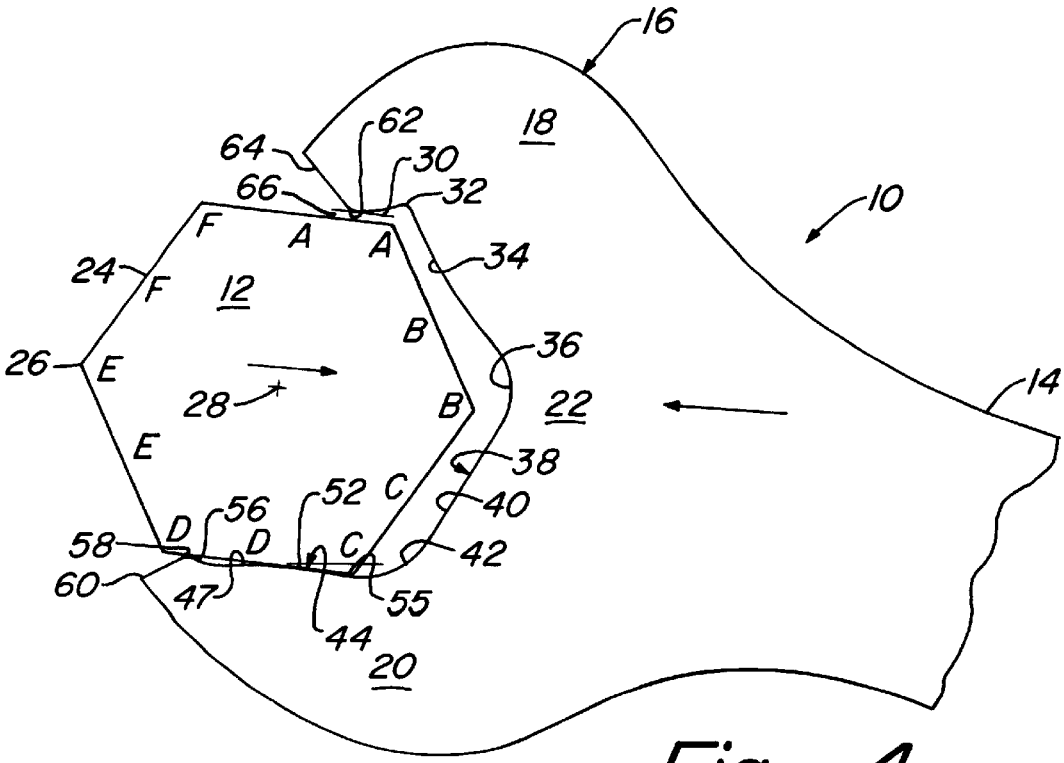
FIG. 4 is a top plan view of the wrench and nut of FIG. 1, shown as the wrench is being slid onto the nut.

Referring to the figures, a ratcheting-type open-end wrench 10 is shown for use with a conventional hexagonal nut or bolt head 12. The wrench 10 has a shaft or handle 14 to which a wrench head 16 is integrally formed. The wrench head 16 has upper and lower jaws 18, 20 that are spaced apart and joined together at one end by a web 22.

FIG. 1 shows the wrench head 16 engaged with the nut 12 in a drive position, with the wrench head 16 oriented at a zero degree approach angle. Unless otherwise stated, specific dimensions given for the wrench head are for use with hexagonal nuts where the maximum nut size is two inches as measured from flat to flat. References to the nut and relative positions are also with respect to the maximum size nut. Such references and dimensions are given for ease of description and understanding purposes only and should in no way be construed as limitations. It should be readily apparent to those skilled in the art that these dimensions will vary from wrench to wrench depending on the size of the nut it is designed for. The nut 12 has six flats 24 with adjacent flats intersecting at approximately 120° to form corners 26. The individual flats 24 and corners 26 are each designated with an A, B, C, D, E or F for ease of description. Each corner 26 is located an equal distance from a center point 28 of the nut 12.

Figure 2:
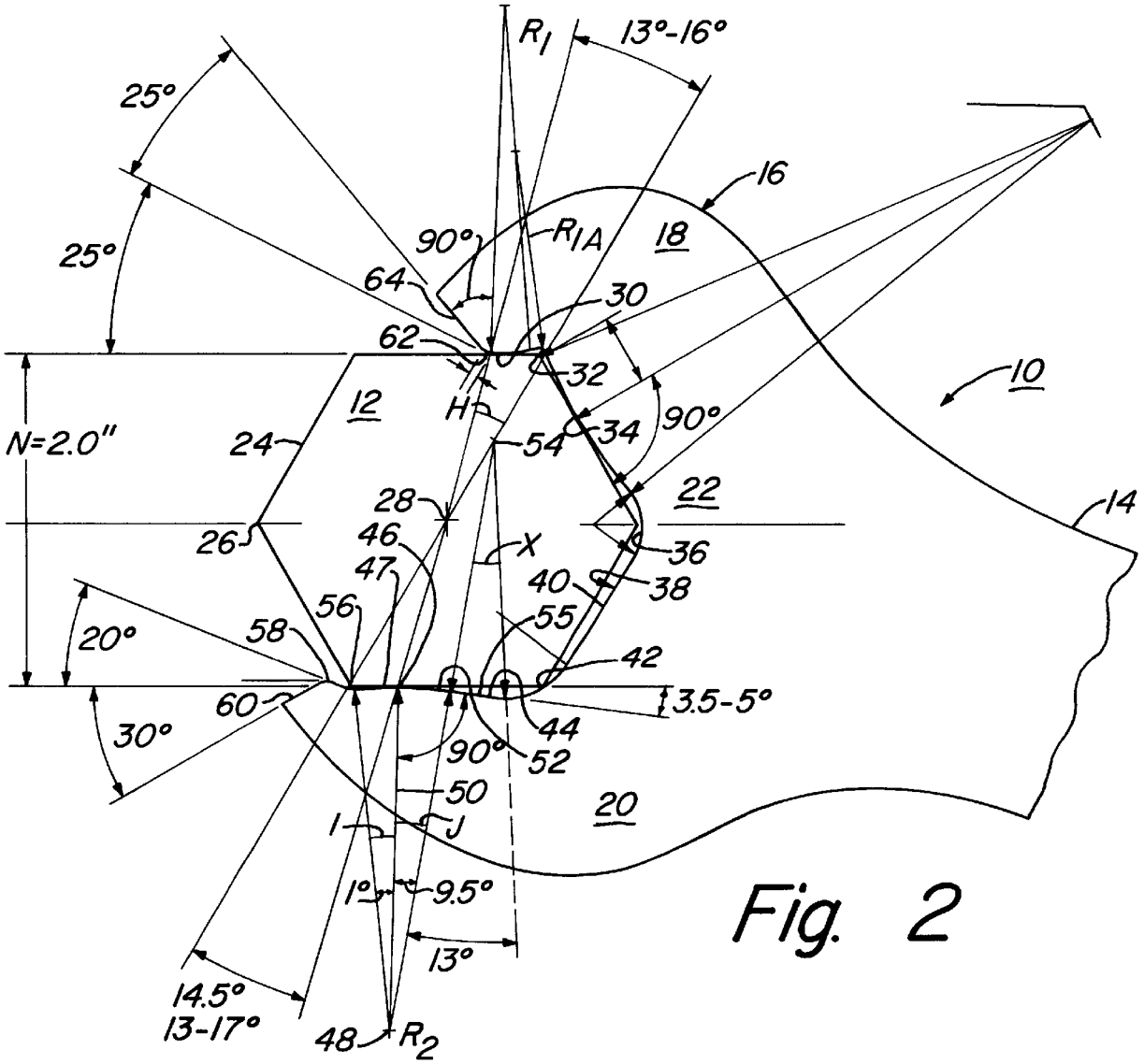
FIG. 2 is another top plan view of the wrench of FIG. 1, shown engaged with a nut having maximum dimensions.

Located on the forward end portion of the upper jaw 18 is an upper drive face 30. Referring to FIG. 2, with the nut 12 and wrench head 16 in the drive position, the drive face 30 extends a distance along the flat 24A forward from the corner 26A a distance defined by an angle H of 13° to 16° extending forward from the corner 26A, as measured from the center point 28 of the nut 12. Unless otherwise stated, all angles specified are measured with the point of convergence coinciding with the centerpoint of the nut 12 and with the nut 12 in the drive position. Further, the curvature and shape of the faces described is the substantially the same through any cross section of the wrench head 16 throughout its thickness. The upper drive face 30 is a convex arcuate surface with the forward portion of the drive surface, which constitutes approximately 10° of angle H, having a radius of curvature $R_1$ of about 0.75×N to about 1.25×N, where N is the maximum width of the nut 12 to be driven. The drive surface of the drive face 30 then continues rearward from the forward portion with a convex curvature having a radius of curvature $R_{1A}$ of about 0.6×N. This rearward portion merges with a concave fillet 32 that provides a clearance so that the corner 26A does not touch the wrench head 16.

Extending from the upper drive face 30 is an upper backstop face 34 that is joined to the drive face 30 by means of the fillet 32. The backstop 34 extends along the nut flat 24B from corner 26A to 26B. The backstop 34 is a convex curved surface having a single radius of curvature of about 1.75×N which converges smoothly with fillet 32 at one end and a fillet 36 at the other end. The apex of the backstop 34, where the backstop 34 contacts or is tangential to the nut flat 24B, is located at a position above the center of the backstop 34. The fillet 36 is a concave curve having a radius of curvature of about 0.3150 inches or 0.1575×N. As shown in FIGS. 1 and 2, the fillet 36 is configured so that the corner 26B does not touch the wrench head 16 when in the drive position.

Joined to the upper backstop 34 by means of the fillet 36 is a lower backstop face 38. The lower backstop 38 generally coextends with the nut flat 24C from corner 26B to 26C. The lower backstop 38 has a flat-plane midsection 40 that is offset a distance of approximately 0.3×N from the nut flat 24C when in the drive position. Alternatively, this may be a curved surface, as will be discussed for the embodiment shown in FIG. 9. The flat-plane midsection 40 joins the fillet 36 at one end and at a concave fillet 42 at the other. The fillet 42 has a single radius of curvature of about 0.4515 inches or 0.2258×N. As shown in FIGS. 1 and 2, the corner 26C is tangential to the fillet 42 and may just touch at the approximate center of the fillet 42. This may not always be the case in actual use, however, as worn nuts with rounded corners may not touch the fillet 42 when in the drive position, nor will any nut of a given size that is less than ANSI maximum manufactured size, known as "nominal size."

A lower jaw face 44 is joined to the lower backstop 38 and extends along the nut flat 24D between corner 26C and 26D, as shown in FIG. 1. Beginning at a point 46 (FIG. 2) located between 13° to 17° rearward from the corner 26D, which is tangential to the nut flat 26D, the lower jaw face 44 is a convex arcuate surface 47 which forms a lower drive face having a single radius of curvature $R_2$ of between about 0.75×N to about 1.25×N, depending on the nut size to be driven and that nut's allowed manufacture tolerance. This lower drive face 47 extends forward along the lower jaw face 44 from the point 46 a distance defined by an angle I of about 7°, where the angle I has a point of convergence 48 located along a line 50 extending perpendicular outward at point 46 from the nut flat 24D at a distance equal to $R_2$. The point 46 constitutes an apex of the lower drive face 47. The vertical distance between the lowermost point or apex of the upper drive face 30 and the uppermost point or apex 46 of the lower drive face 47 should be equal to the maximum nut width or N.

Rearward from point 46 on the lower jaw face 44 the surface is a flat plane 52 that slopes downward at an angle of between 3.5° to 5° away from the nut flat 24D for a distance measured by the angle J having its point of convergence at point 48 as measured from the line 50. The angle J is approximately 9.5°.

Extending rearward from the area 52 is a slide face 55 that is a concave curved surface having a single radius of curvature of about 0.773×N that curves through an arc to the fillet 42. The arc is defined by angle K, which is about 13°, with the convergence point 54 of the angle located at the midpoint of a line extending from the center 28 of the nut 12 to the corner 26, when the nut 12 is in the drive position.

Figure 3:
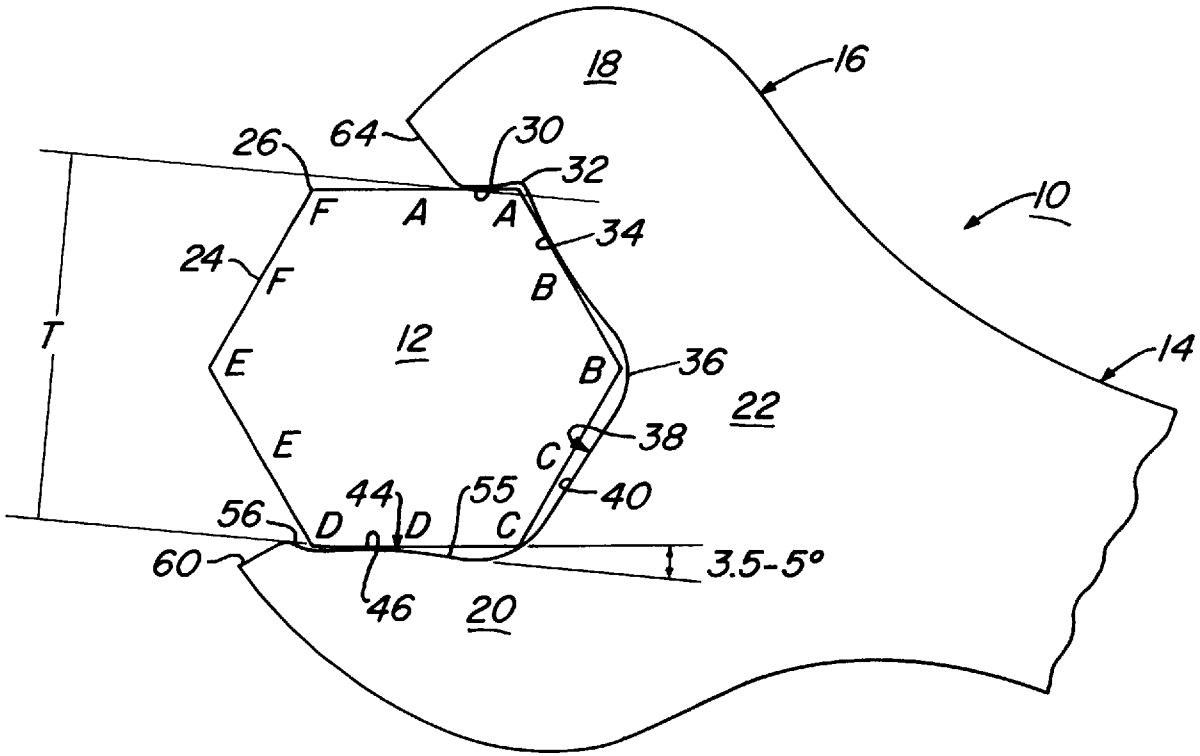
FIG. 3 is a top plan view of the wrench of FIG. 2, shown with a nut in the drive position.

As shown in FIG. 3, the line extending through the point 46 and passing through the lowermost point of the slide face 55 is at an angle of between about 3.5° to 5° to the side 24D of the nut 12 when in the drive position. The distance between this line and the parallel line passing through the apex or lowermost point of the upper drive face 30, where the drive face 30 contacts side 24A, is measured as T. The measurement T is slightly greater than the maximum side-to-side diameter of the nut 12. The "T" dimension needed to ratchet a nominal size nut is about 1.014×N. For a two-inch nut, for example, an adequate distance has been found to be about 2.0278 inches. This clearance allows the wrench 10 to be rotated about the nut 12 during ratcheting, as will be discussed further on.

Alternatively, as will be discussed for the embodiment of FIG. 9, a single flat plane may be used to connect point 46 and fillet 42, requiring only that this flat plane is at an angle from 3.5° to 5° downward from nut plane D when the nut is in the drive position.

Extending forward from the lower drive face 47 is a lock face or lip 56. The lock face 56 may be formed as a single flat plane or a slight concave curve that slopes upward generally from the lower drive face 47 at an angle of between 15° to 20°, relative to the nut flat 24D or a line drawn tangent to point 46. Alternatively, the lock face may be configured as is discussed for the embodiment shown in FIGS. 9 and 10.

A nose drive face 58 extends forward from the lock face 56 and is parallel and slightly above the nut flat 24D, with the vertical distance between the forwardmost end of the lock face 56 and the upper drive face 30 being less than the side-to-side diameter of the nut 12. The portion 58 has a length about equal to the lock face 56. Although the wrench head 16 is shown with the portion 58 as a flat plane, it is preferably arcuate with a slight convex curve. The nose drive face 58 drives the lower nut flat 24D when the wrench is at high angles of approach.

An end portion 60 of the lower jaw 20 extends forward from the portion 58 at an angle downward, relative to the nut flat 24D. This angle may vary widely, but is shown here at 30°.

Extending forward from the upper drive face 30 on the upper jaw 18 is a flat 62 that is oriented at an angle of about 25° from the nut flat 24A. The flat 62 has a length of about 0.05 inches. This area may be a slight convex curve also. The end portion 64 of the upper jaw 18 extends upward from the flat 62 at an angle of at least about 25° or 50° from the nut flat 24A.

Now with reference to the FIGS. 4–7, the operation of the wrench 10 is as follows. Initially, the wrench head 16 is slid over the nut 12, with the wrench 10 rotated counter clockwise at an angle of about 7° to 30° relative to the nut 12 from what is shown in FIG. 1, where the nut 12 is in the drive position. In this way, a slight clearance 66 is provided between the flat 62 of the upper jaw 18 and the lock face 56 of the lower jaw 20 to allow passage of the nut 12 between the jaws 18, 20. As the nut 12 is slid rearward, the nut flat 24B will eventually contact the upper backstop 34.

With the nut flat 24B in contact with the backstop 34, the wrench 10 can then be rotated clockwise until the wrench head 16 and nut 12 are in the drive position, as shown in FIG. 1. While this is being done, the nut flat 24B should be maintained in contact with the back stop 34. When in the drive position, the upper drive face 30 bears against the rearward portion of the nut flat 24A, and the lower drive face 47 bears against forward portion of the nut flat 24D for maximum torque. The wrench 10 can then be rotated downward or clockwise to either loosen or tighten the nut 12.

Figure 5:
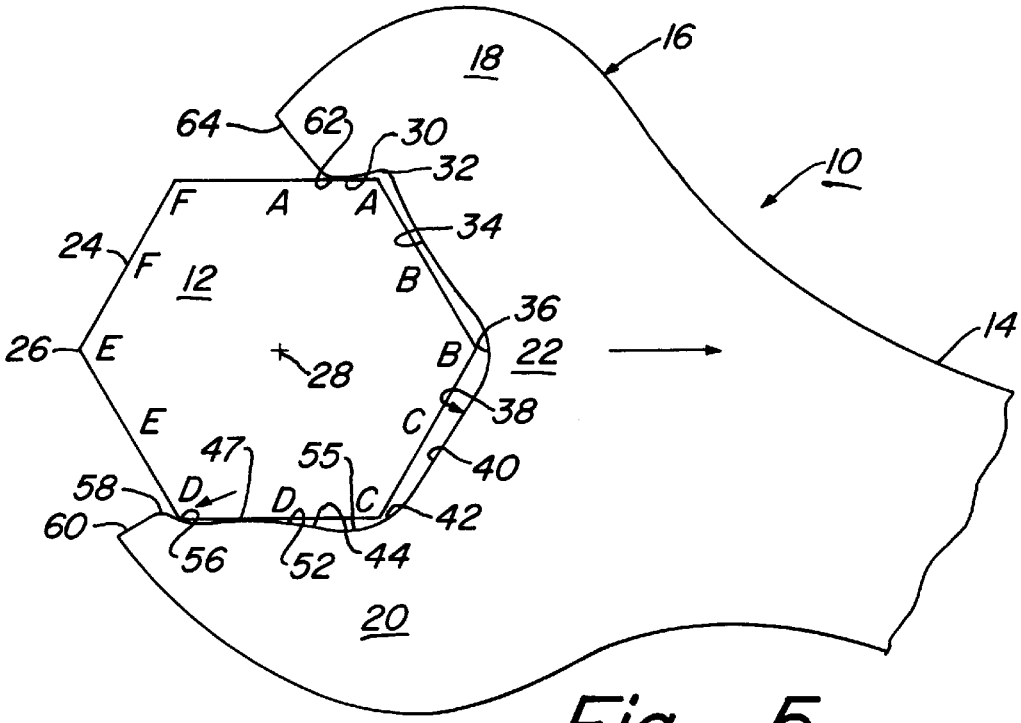
FIG. 5 is a top plan view of the wrench and nut of FIG. 1, shown in the locked position.

When the wrench 10 is pulled directly rearward relative to the nut 12 from the drive position, as shown in FIG. 5, the nut corner 26D will contact the lock face 56. Because the vertical distance between the lock face 56 and the upper drive face 30 is slightly less than the width of the nut 12, the sloped lock face 56 essentially wedges the nut between the lock face 56 and upper drive face 30 to prevent further rearward movement of the wrench head 16 relative to the nut 12. In this way, the wrench 10 is locked onto the nut 12 to help prevent the wrench 10 from slipping off the nut 12 during use. It should be noted that the wrench head 16 of FIG. 2 is shown with a maximum sized nut, so that both the drive and locked positions are essentially the same.

Figure 6:
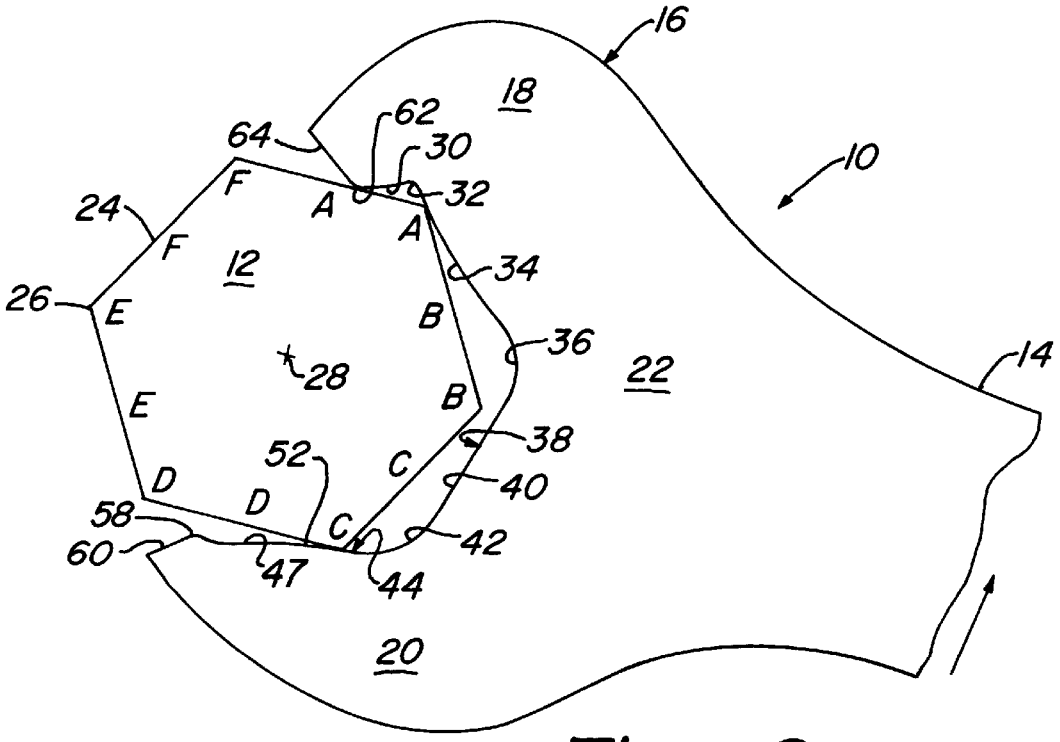
FIGS. 6 and 7 are top plan views of the wrench and nut of FIG. 1, shown in various positions as the wrench is being ratcheted about the nut.
Figure 7:
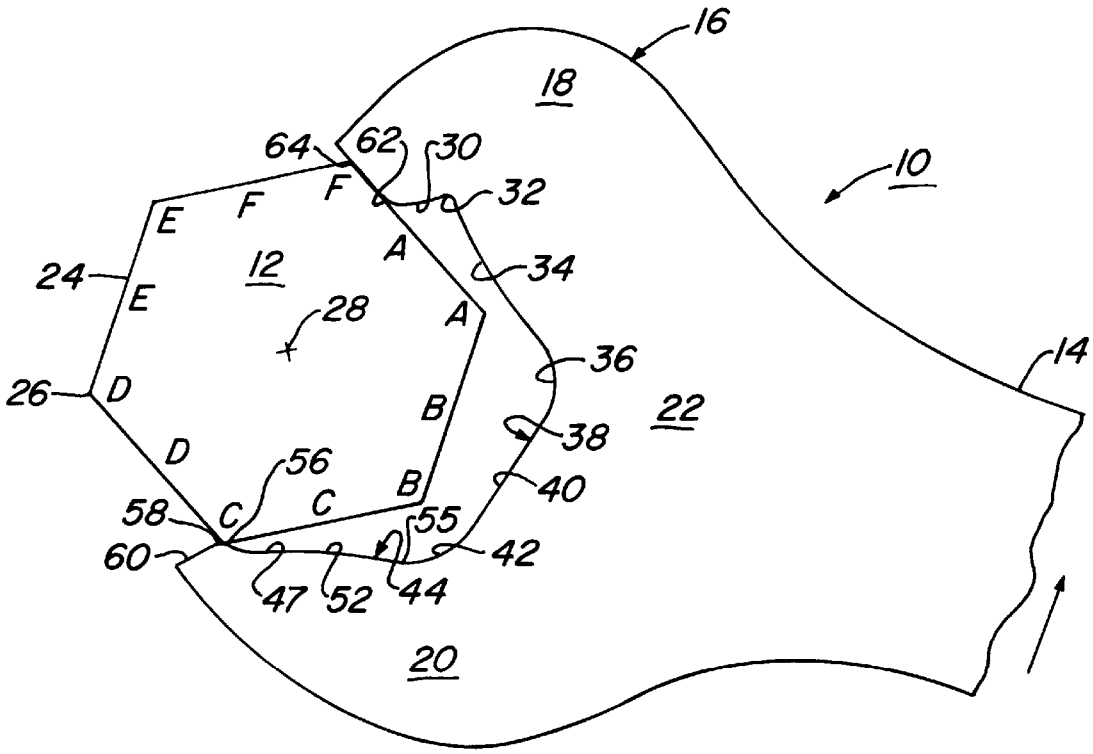
Figure 8:
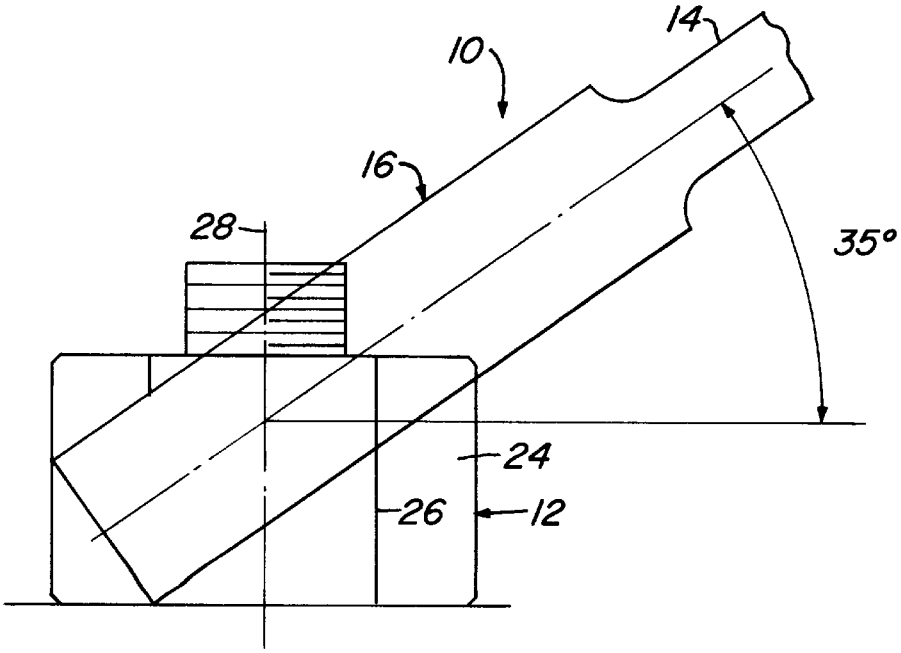
FIG. 8 is a side view of the wrench and nut of FIG. 1, shown with the wrench at a 35° approach to the nut.

The wrench 10 can be repositioned on the nut 12 in 60° increments for further tightening or loosening, without the removal of the wrench head 16 from the nut 12. Referring to FIGS. 6 and 7, this is accomplished by rotating the wrench 10 counter clockwise relative to the nut 12, while forcing the wrench 10 slightly forward to maintain constant contact with the nut 12. Initially, the nut corner 26C will slide from the fillet 42 across the lower jaw face 44. As this is occurring, the nut face 24B and nut corner 26A will slide across the upper backstop 34 (FIG. 6). The offset lower backstop 38 never contacts the nut 12, facilitating ease of rotation. With continued rotation, the nut corner 26C will eventually contact the lock face 56. The wrench 10 is further rotated with the upper end portion 64 sliding across the nut flat 24A and over corner 26F. With slight forward pressure being exerted on the wrench 10 against the nut 12, when the upper end portion 64 is slid over the corner 26F, the nut 12 and wrench head 16 will naturally position themselves in a new drive position. In this way, continued tightening or loosening of the nut can be achieved.

The jaw design allows the wrench 10 to be locked on and ratcheted at steeper angles of approach than have prior art open-end ratcheting wrenches. The angle of approach is more clearly illustrated in FIG. 58. Here the angle of approach of the wrench 10 with the nut 12 is at 35°. The wrench 10 remains locked on up to angles of 35°. Driving and ratcheting at angles up to 45° can be achieved with the wrench design. It is preferred, however, that the wrench be used at an angle of approach between 0° to 25°.

Figure 9:
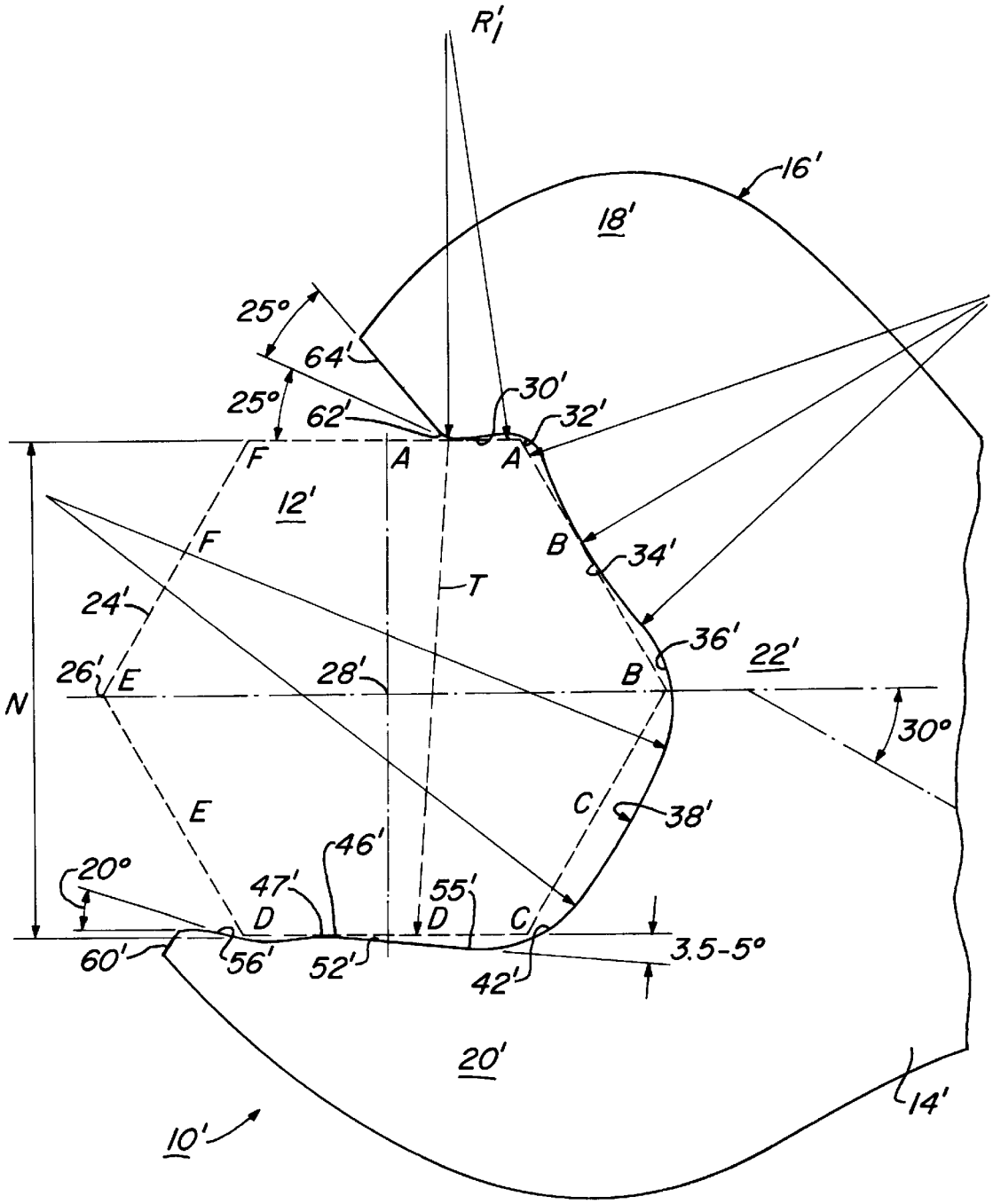
FIG. 9 is a top plan view of another embodiment of the wrench shown engaged with a nut in the drive position and constructed in accordance with the invention.
Figure 10:
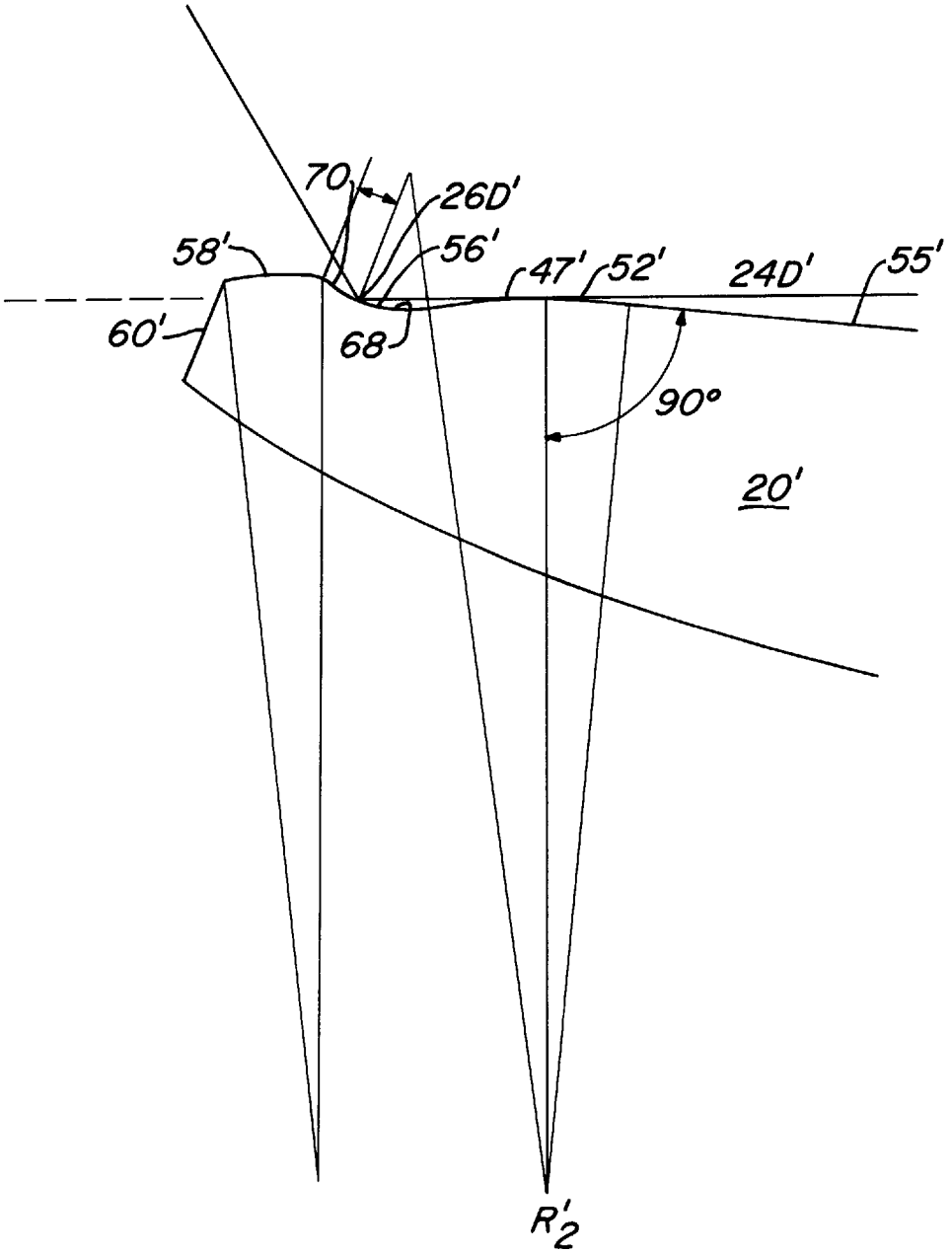
FIG. 10 is an enlarged top plan view of a lower jaw of the wrench of FIG. 9.

FIGS. 9 and 10 show another embodiment of the wrench. Similar elements as those of the embodiment of FIGS. 1–8 have the same number but are designated with a prime symbol. In the embodiment of FIG. 9, the upper drive surface 30' has a single convex radius of curvature $R_1'$ equal to about 0.875×N. This drive face 30' merges with the concave fillet 32'. The upper backstop face 34' has a smaller radius of curvature of about 1.0×N, with the apex or point tangential to the nut flat being located above the midpoint of the backstop face 34'. On a wrench designed for a two-inch nut, for example, this apex may be located 0.464 inches, or 0.232×N from the corner 26A'. The lower backstop 38' is a concave surface. The backstop 38' may have a single radius of curvature. A suitable radius of curvature is about 1.375×N. As discussed previously, the backstop 38' should be spaced from the nut 12' at all positions. The flat plane 52' and slide plane 55' are formed into a single plane that is 3.5° to 5° from the adjacent nut flat when in the drive position. The measurement T, in this case, is that distance along a line extending between the apex of the drive face 30 and that point on the slide face 55' where the line is perpendicular.

Referring to FIG. 10, the lock face 56' is an arcuate concave curved surface 68 at its rearward end having a radius of curvature of about 0.15×N. The curve 68 merges smoothly into the convex curvature of the lower drive face 47'. The concave portion 68 of the lock face 56' terminates at the corner 26D'. A flat portion 70 of the lock face 56' slopes upward, from the curved portion 68 past the corner 26D'. The flat portion 70 is at an angle of less than or equal to about 20° relative to the side 24D' of the nut 12', and preferably between 15° to 20°. The flat portion 70, in the embodiment shown, has a length of about 0.055×N. Alternatively, the lock face 56' may be a single concave curved surface. Extending forward from the lock face 56' is portion 58'. The portion 58' is a convex curved surface instead of a flat plane. A suitable radius of curvature for the portion 58' may be equal to the radius $R_2'$.

The wrench design of the invention provides several advantages. When the wrench head and nut are in the drive position, there is no corner contact with any wrench drive surfaces. Thus, there is no rounding off or wearing of the nut corners. The arcuate drive faces also compensate for variations in nut and wrench manufacturing tolerances, while still maintaining contact on the nut flat. The drive faces are positioned on the nut flats for maximum torque. When the wrench is in place on the nut and held toward the nut, it will automatically assume a drive or ratchet position due to its geometry when rotated on the nut in either the ratchet or drive direction. The lock face design prevents the wrench from being pulled off the nut during use while also allowing a steeper angle of approach to be used in ratcheting and driving the nut than in prior art wrenches.

While the invention has been shown in some of its forms, it should be apparent to those skilled in the art that it is not so limited but is susceptible to various changes without departing from the scope of the invention.

I claim:

1. An open-end ratcheting-type wrench for use in driving a hexagonal nut, the wrench comprising:

upper and lower jaws that are rigidly joined together, the jaws being immovable and spaced apart relative to the other for receiving a hexagonal nut to be driven;

an upper drive face located on a forward end of the upper jaw, the upper drive face being a convex arcuate surface for contacting a first side of the nut being driven when the wrench is in a drive position;

an upper backstop face that adjoins the upper drive face, the upper backstop face having a convex arcuate surface for contacting a second side of the nut adjacent to the first side when the nut is in the drive position, the upper backstop face coextending generally along the length of said second side of the nut when in the drive position;

a lower backstop face that adjoins the upper backstop face and generally coextends along a third side of the nut adjacent to the second side, the lower backstop face being spaced apart from the third side of the nut when the wrench is in the drive position;

a lower jaw face that adjoins the lower backstop face, the lower jaw face generally coextending along an opposite side of the nut from the first side when the wrench is in the drive position, the lower jaw face having a forward portion that forms a lower drive face that is a convex arcuate surface for contacting said opposite side of the nut when in the drive position; and a lock face that adjoins the forward portion of the lower jaw face on a forward end of the lower jaw, the lock face having an arcuate concave surface to resist inadvertent disengagement of the wrench from the nut while torque is being applied.

2. The wrench of claim 1, wherein:

the convex arcuate surface of the lower drive face has an apex; and the lock face has a forward portion that slopes upward generally at an angle of less than about 20 degrees relative to a line tangent to the apex of the lower drive face.

3. The wrench of claim 1, wherein:

a concave fillet exists between each of the adjoining upper drive face and the upper backstop face, the upper backstop face and the lower backstop face, and the lower backstop face and the lower jaw face for providing a clearance for the corners of the nut.

4. The wrench of claim 1, wherein:

the arcuate contact surface of the upper backstop face has an apex located at a position above a midpoint of the upper backstop face.

5. The wrench of claim 1, wherein:

the lower jaw face has a rearward portion that forms a slide face that is spaced from said opposite side of the nut.

6. The wrench of claim 5, wherein:

the slide face is a flat surface that is sloped downward from the lower drive face.

7. The wrench of claim 5, wherein:

the slide face is a concave arcuate surface.

8. The wrench of claim 1, wherein:

the lower backstop face is a flat surface.

9. The wrench of claim 1, wherein:

the lower backstop face is an arcuate concave surface.

10. The wrench of claim 1, wherein:

the end of the upper jaw terminates in an end face that extends upward from the upper drive face at an angle of at least about 50° from the first side of the nut when in the drive position.

11. An open-end ratcheting-type wrench for use in driving a hexagonal nut, the wrench comprising:

a handle;

a wrench head that is joined to the handle, the wrench head having upper and lower jaws that are rigidly joined together, the jaws being immovable and spaced apart relative to the other for receiving the hexagonal nut to be driven;

an upper drive face located on the forward end of the upper jaw, the upper drive face being a convex arcuate surface for contacting a first side of the nut being driven when the wrench is in a drive position;

an upper backstop face that adjoins the upper drive face the upper backstop face having a convex arcuate surface for contacting a second side of the nut adjacent to the first side when the nut is in the drive position, the upper backstop face coextending generally along the length of said second side of the nut when in the drive position, and wherein the arcuate contact surface of the upper backstop face has an apex located at a position above the midpoint of the upper backstop face;

a lower backstop face that adjoins the upper backstop face and generally coextends along a third side of the nut adjacent to the second side, the lower backstop face being spaced apart from the third side of the nut when the wrench is in the drive position;

a lower jaw face that adjoins the lower backstop face, the lower jaw face generally coextending along an opposite side of the nut from the first side when the wrench is in the drive position, the lower jaw face having a forward portion that forms a lower drive face that is a convex arcuate surface for contacting said opposite side of the nut when in the drive position; and a lock face that adjoins the forward portion of the lower jaw face on the forward end of the lower jaw, the lock face sloping upward from the forward portion of the lower jaw face, and wherein the forwardmost end of the lock face is at a position above said opposite side of the nut while in the drive position to resist inadvertent disengagement of the wrench from the nut while torque is applied, the lock face having an arcuate curved surface to allow ratcheting of the wrench on the nut.

12. The wrench of claim 11, wherein:

the convex arcuate surface of the lower drive face has an apex; and the lock face has a forward portion that slopes upward generally at an angle of less than about 20 degrees relative to a line tangent to the apex of the lower drive face.

13. The wrench of claim 11, wherein:

a concave fillet exists between each of the adjoining upper drive face and the upper backstop face, the upper backstop face and the lower backstop face, and the lower backstop face and the lower jaw face for providing a clearance for the corners of the nut.

14. The wrench of claim 11, wherein:

the lower jaw face has a rearward portion that forms a slide face that is spaced from said opposite side of the nut.

15. The wrench of claim 14, wherein:

the slide face is a flat surface that is sloped downward from the lower drive face.

16. The wrench of claim 14, wherein:

the slide face is a concave arcuate surface.

17. The wrench of claim 11, wherein:

the lower backstop face is a flat surface.

18. The wrench of claim 11, wherein:

the lower backstop face is an arcuate concave surface.

19. The wrench of claim 11, wherein:

the end of the upper jaw terminates in an end face that extends upward from the upper drive face at an angle of at least about 50° from the first side of the nut when in the drive position.

* * * * *